US006405437B1

(12) United States Patent
Sussmilch et al.

(10) Patent No.: US 6,405,437 B1
(45) Date of Patent: Jun. 18, 2002

(54) APPARATUS AND METHOD FOR ENCASING AN OBJECT IN A CASE

(75) Inventors: Wilfried Sussmilch, Rheda-Wiedenbruck (DE); Mick Wadsworth, Garstang (GB); Lei Boure, Maasbrathd (NL)

(73) Assignee: ArvinMeritor, Inc., Troy, MI (US)

( * ) Notice: Subject to any disclaimer, the term of this patent is extended or adjusted under 35 U.S.C. 154(b) by 0 days.

(21) Appl. No.: 09/508,722

(22) PCT Filed: Sep. 15, 1998

(86) PCT No.: PCT/US98/19147

§ 371 (c)(1),
(2), (4) Date: May 19, 2000

(87) PCT Pub. No.: WO99/14119

PCT Pub. Date: Mar. 25, 1999

Related U.S. Application Data

(60) Provisional application No. 60/074,857, filed on Feb. 17, 1998.

(30) Foreign Application Priority Data

Sep. 17, 1997 (DE) ..... 297 16 671 U

(51) Int. Cl.[7] ..... B23Q 3/06; B23P 17/00; B65D 63/06; F16L 3/12; B25B 1/20

(52) U.S. Cl. ..... 29/890.08; 24/279; 29/33 K; 269/108

(58) Field of Search ..... 29/33 R, 33 K, 29/890.08; 269/42, 108, 131; 24/279; 285/408

(56) References Cited

U.S. PATENT DOCUMENTS 891,121 A * 6/1908 Wichers ..... 269/108
2,395,745 A * 2/1946 King ..... 24/279
3,151,632 A * 10/1964 Risley et al. ..... 24/279
3,159,239 A 12/1964 Andrews
3,584,860 A * 6/1971 Ervin ..... 269/131
3,848,638 A * 11/1974 Muslander et al. ..... 24/279 X
3,876,384 A 4/1975 Santiago et al.
3,958,312 A 5/1976 Weaving et al.
3,972,687 A 8/1976 Frietzsche
3,984,207 A 10/1976 Abthoff et al.
4,002,317 A * 1/1977 Fischer ..... 249/79
4,070,158 A 1/1978 Siebels
4,144,627 A 3/1979 Noda et al.
4,148,120 A 4/1979 Siebels
4,155,980 A 5/1979 Santiago et al.
4,160,010 A 7/1979 Ottle
4,163,042 A 7/1979 Lynch
4,171,799 A * 10/1979 Elko ..... 269/108

(List continued on next page.)

FOREIGN PATENT DOCUMENTS

DE 3430398 A1 2/1986
GB 1568303 5/1980
GB 2290036 12/1995

*Primary Examiner*—William Briggs
(74) *Attorney, Agent, or Firm*—Barnes & Thornburg

(57) ABSTRACT

An encasement machine (10) is provided to clamp a case (32) around an object (28) having a contour. The machine (10) includes a spacer mount (20), an actuator (14, 16), and a spacer (22). The spacer mount (20) defines an encasement region (26) and is adapted to receive the object (28) and case (32) in the encasement region (26). The actuator is coupled to the spacer mount (20) to move the spacer mount (20) between first and second positions. The spacer (22) is coupled to the spacer mount (20) to move with the spacer mount (20) between the first and second positions. The spacer (22) has a first surface (54) coupled to the spacer mount (20) and a second surface (52) that is adapted to face toward the object (28) and case (32). The second surface (52) has a contour that is substantially identical to the contour of the object (28).

48 Claims, 12 Drawing Sheets

U.S. PATENT DOCUMENTS 4,179,784 A * 12/1979 Warren et al. ..... 24/279
4,180,544 A 12/1979 Santiago
4,218,051 A * 8/1980 Stasny ..... 269/131
4,278,639 A 7/1981 Tadokoro et al.
4,282,186 A 8/1981 Nonnenmann et al.
4,322,388 A 3/1982 Hardin et al.
4,335,077 A 6/1982 Santiago et al.
4,343,074 A 8/1982 Bailey et al.
4,344,921 A 8/1982 Santiago et al.
4,344,922 A 8/1982 Santiago et al.
4,400,860 A 8/1983 Nonnenmann et al.
4,409,708 A * 10/1983 Hauffe ..... 24/279
4,413,388 A * 11/1983 Akhtar-Khavari et al. .... 24/279
4,488,744 A * 12/1984 Bubeck et al. ..... 285/408
4,504,294 A 3/1985 Brighton
4,519,120 A 5/1985 Nonnenmann et al.
4,560,153 A * 12/1985 Han ..... 269/42
4,667,386 A 5/1987 Enomoto et al.
4,738,013 A 4/1988 Yamashita et al.
4,775,518 A 10/1988 Abthoff et al.
4,782,570 A 11/1988 Spridco
4,818,497 A 4/1989 Andersson et al.
4,871,621 A 10/1989 Bagley et al.
4,969,264 A 11/1990 Dryer et al.
4,997,148 A * 3/1991 Sherman ..... 24/279 X
5,004,018 A 4/1991 Bainbridge
5,055,274 A 10/1991 Abbott
5,096,111 A 3/1992 Ishikawa et al.
5,105,516 A 4/1992 Enomoto et al.
5,118,476 A 6/1992 Dryer et al.
5,173,267 A 12/1992 Maus et al.
5,273,724 A 12/1993 Bos
5,293,743 A 3/1994 Usleman et al.
5,329,698 A 7/1994 Abbott
5,408,828 A 4/1995 Kreucher et al.
5,634,251 A 6/1997 Kraft
5,683,660 A 11/1997 Wirth et al.
5,829,132 A 11/1998 Sickels et al.
5,870,804 A * 2/1999 Wylin ..... 24/279
5,918,866 A * 7/1999 Klimach ..... 269/108

* cited by examiner

APPARATUS AND METHOD FOR ENCASING AN OBJECT IN A CASE

This application claims the benefit of provisional application Ser. No. 06/074,857 filed Feb. 17, 1998.

The present invention relates to an apparatus and method for encasing an object in a case. More particularly, the present invention relates to an apparatus and method for encasing objects having non-circular contours in a case.

Exhaust processors are part of a vehicle exhaust system that cleans and quiets exhaust gas produced by a vehicle engine. The exhaust processors typically include a substrate or object encased within a metal sheet. The size and contour of the exhaust processors depends, in large part, on the space available for the exhaust processor in the vehicle exhaust system on the underside of the vehicle.

According to the present invention, a machine is provided to clamp a case around an object having a contour. The machine includes a spacer mount, an actuator coupled to the spacer mount to move the spacer mount between first and second positions, and a spacer coupled to the spacer mount to move with the spacer mount between the first and second positions. The spacer mount defines an encasement region and is adapted to receive the object and case in the encasement region. The spacer includes a first surface coupled to the spacer mount and a second surface adapted to face toward the object and case. The second surface of the spacer has a contour that is substantially identical to the contour of the object.

A method is also provided for encasing an object having a contour within a case. An encasement machine is provided having an actuator and a plurality of strap units. The plurality of strap units include an inner surface adapted to face toward the object and the inner surface includes a contour. One of the plurality of strap units is selected that includes an inner surface having a contour substantially similar to the contour of the object. The selected strap unit is coupled to the actuator. The object is placed within the case. The object and case are placed within the encasement machine so that the inner surface of the one of plurality of strap units faces toward the case and object. The actuator is operated to move the selected strap unit so that the strap unit clamps the case on the object.

Additional features and advantages of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

An encasement machine is provided to clamp a case about an object to press and fasten the case about the object. The encasement machine may clamp cases about objects of various contours and sizes. The encasement machine includes a spacer mount that clamps the object and a spacer positioned between the object and spacer mount to position the spacer mount at a selected distance from the object. The spacer includes a surface facing the object that has a contour that is substantially similar to the contour of the object to be clamped.

In FIGS. 1–12, the object is an exhaust processor body used in a vehicle exhaust system (not shown). The exterior size and contour of the exhaust processor body varies depending on the particular vehicle for which the exhaust processor body is intended because exhaust processor bodies have to be adapted to the configuration of the floor pan of the vehicle. The spacer used in the encasement machine is selected to match the size and exterior contour of the particular exhaust processor body to be produced.

Figure 1:
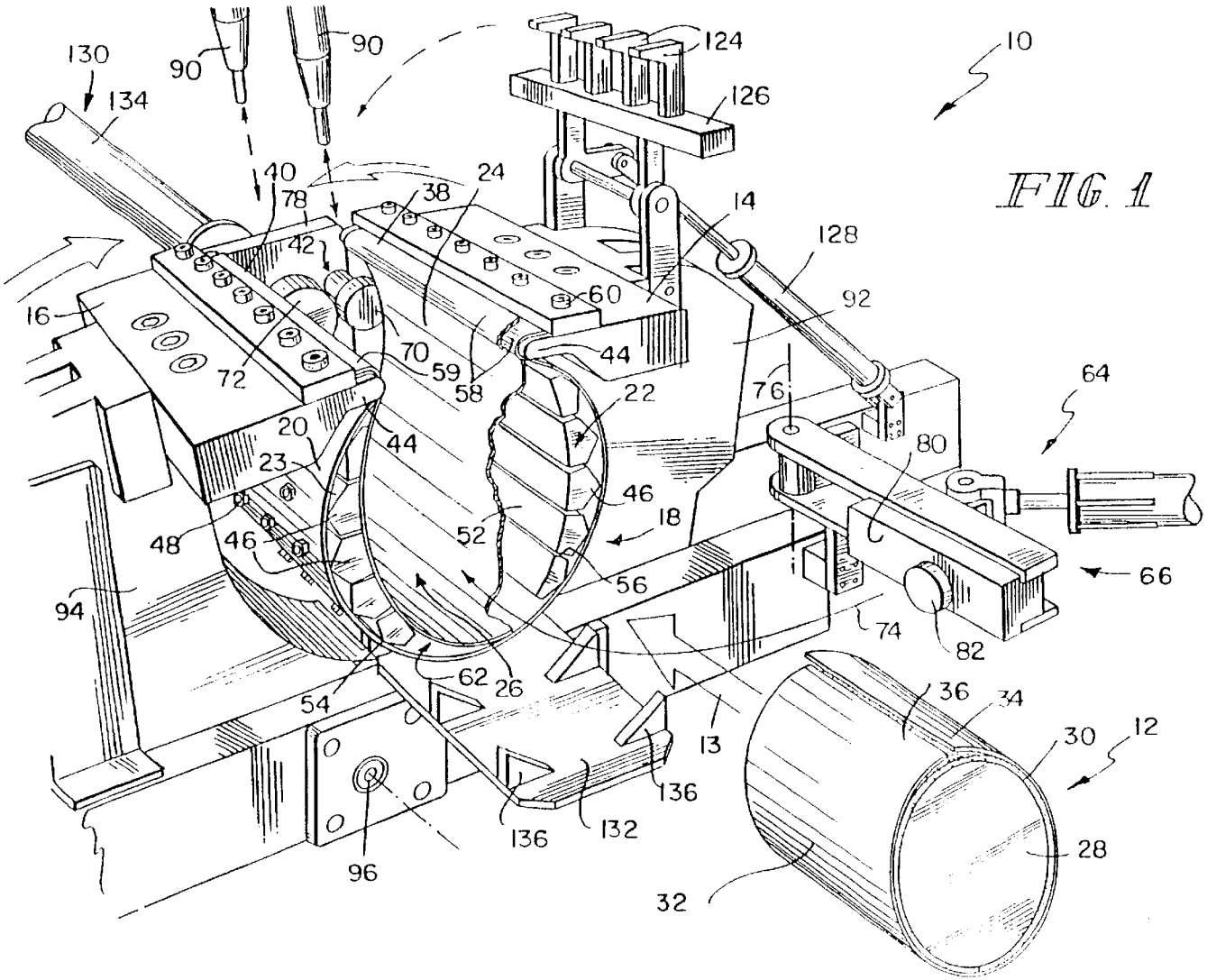
FIG. 1 is an exploded perspective view of an encasement machine and an exhaust processor body including an outer case loosely wrapped around a substrate and mat, the encasement machine including spaced-apart jaws and a "horseshoe-shaped" strap unit positioned to extend between the spaced-apart jaws and formed to define an encasement reunion sized to receive the exhaust processor body so that the body can be clamped in the encasement machine during welding on the body, the strap unit including a spacer mount, a wall, and spacers positioned between the wall and spacer mount and sized to cause the encasement region to match the size and shape of the exhaust processor body.
Figure 2:
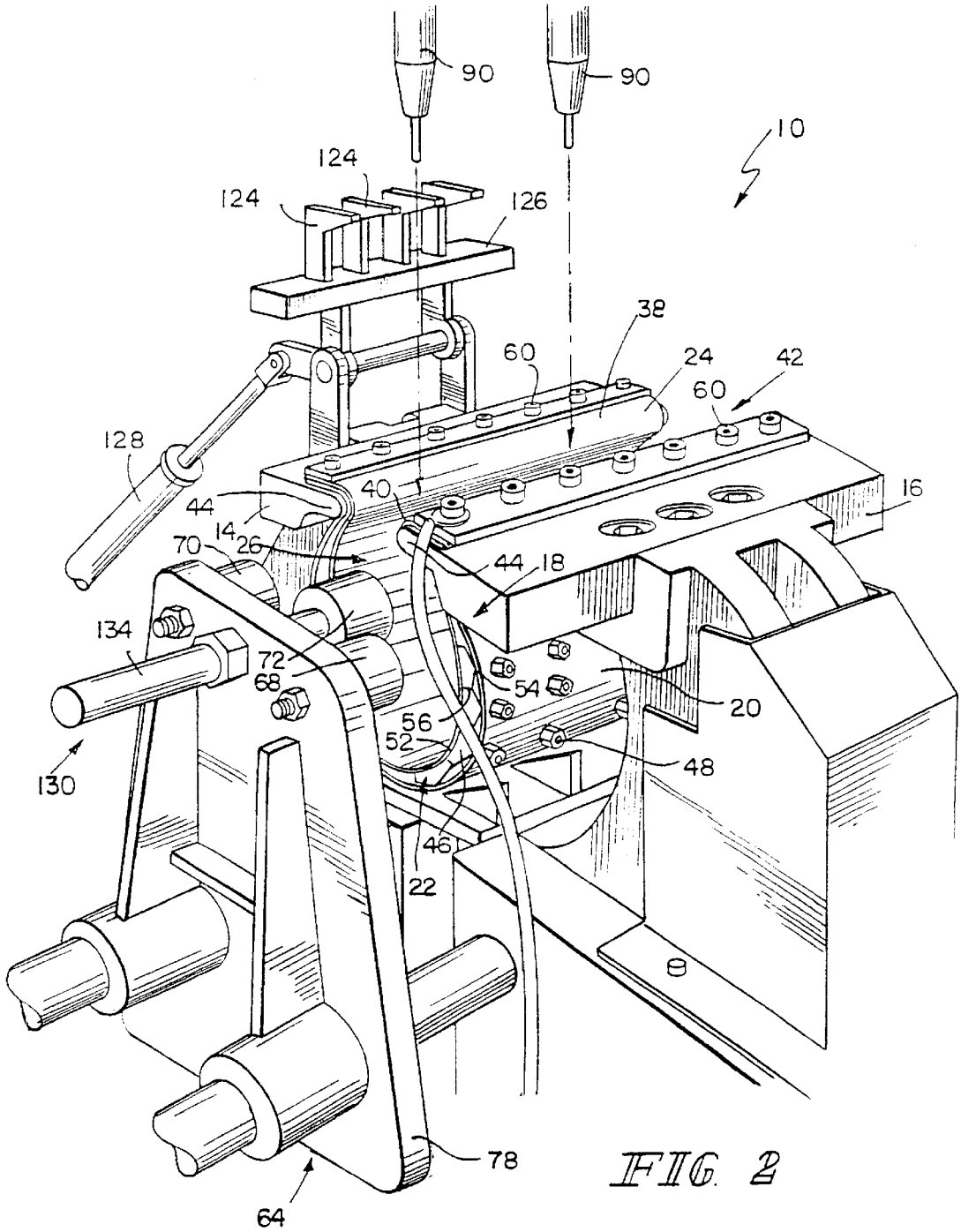
FIG. 2 is another perspective view of the encasement machine of FIG. 1 prior to insertion of an exhaust processor body into the encasement region formed in the encasement machine.
Figure 3:
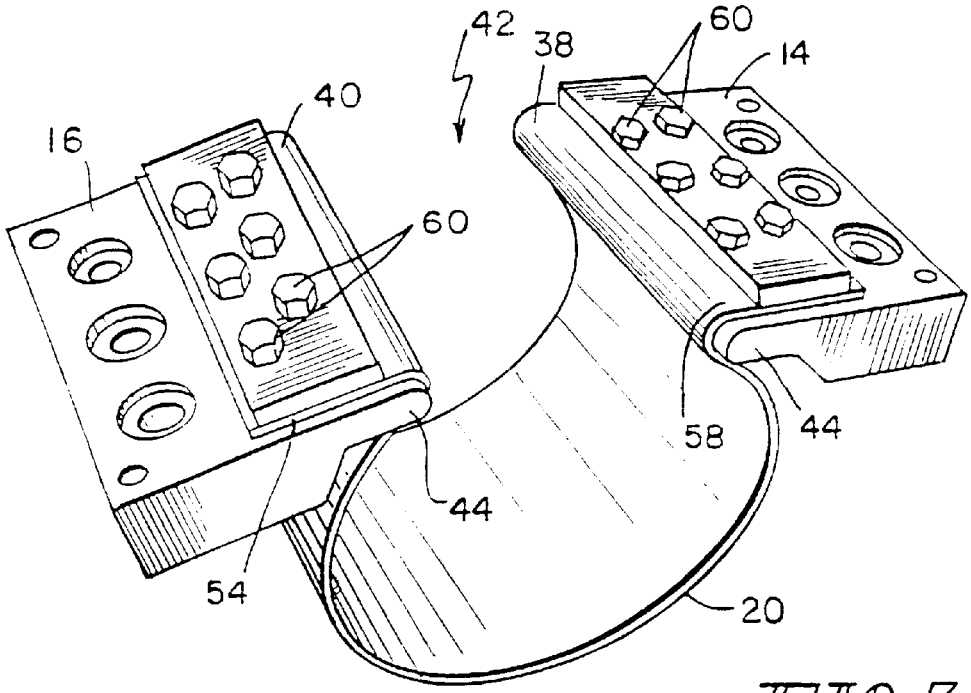
FIG. 3 is a perspective view of a portion of the horseshoe-shaped strap unit and a portion of the spaced-apart jaws supporting the strap unit.

Encasement machine 10 used to clamp an exhaust processor body 12 is shown, for example, in FIGS. 1 and 2 so that body 12 can be welded or otherwise finished. The encasement machine 10 includes first and second clamp jaws 14, 16 and a strap unit 18 that extends between jaws 14, 16. Strap unit 18 includes a spacer mount 20 that extends between jaws 14, 16, a wall 24 that extends between jaws 14, 16, and a spacer 22 coupled to spacer mount 20. Spacer mount 20 and wall 24 define a spacer container region 23 and spacer 22 is positioned to lie between spacer mount 20 and wall 24 in spacer container region 23. The strap unit 18 defines an encasement region 26 in which a partly finished exhaust processor body 12 is positioned when exhaust processor body 12 is clamped. A partly finished exhaust processor body 12 is shown, for example, in FIG. 1 before insertion of body 12 in direction 13 into encasement region 26.

Before exhaust processor body 12 is placed within encasement region 26 of encasement machine 10, exhaust processor body 12 must be partially assembled. Exhaust processor body 12 includes a ceramic honeycomb substrate 28, a support or anchor mat 30 wrapped around substrate 28, and an outer case 32. The substrate 28 may be a single block, or it may be implemented as two or more separate blocks or units which may be arranged axially together or axially spaced. Mat 30 is made of an intumescent material or other suitable material.

The substrate 28 and mat 30 are positioned within outer case 16 using any suitable technique. The case 32 is in a loose, open-sided form so that substrate 28 and mat 30 may be slid within case 32. The case 16 includes spaced-apart first and second ends 34, 36. First end 34 is flared upwardly compared to second end 36 as shown in FIG. 1. The loose case 32 may be formed by bending a generally flat metal sheet.

Once substrate 28 and mat 30 are positioned within case 32, the substrate 28, mat 30. and case 32 are collectively referred to as exhaust processor body 12. The exhaust processor body 12 is placed within encasement machine 10 to press and wrap case 32 around substrate 28 and mat 30 and firmly hold case 32 so that it can be welded or otherwise finished.

The strap unit 18 is made of metal (for example, steel) and is arranged in a generally circular configuration. The strap unit 18 includes spaced-apart ends 38, 40 that are turned away from each other to define a gap 42 as shown, for example, in FIG. 1. Each of the jaws 14, 16 have tips or lugs 44 around which ends 38, 40 of strap unit 18 pass, and to which ends 38, 40 are secured by bolts 60 on an upper surface of each jaw 14, 16. The term "strap" as used in this application is intended to be interpreted broadly, and includes any suitable device(s) or member(s) for bracing or embracing the sheet metal case. As an example, the strap may be formed by a flexible (or capable of flexing) wall or sheet, or by a plurality of discrete parallel filaments, or by a web, or a chain. The strap may be, for example, a band, plate, or loop for binding objects together or for clamping an object in position.

The spacer 22 includes a plurality of elongated spacer members 46 secured to spacer mount 20 by nuts and bolts 48. Each of the elongated spacer members 46 include an inner surface 52 facing wall 24, a pointed outer end or surface 54 engaging spacer mount 20, and a side surface 56. Any suitable mounting device or connector may be used to mount elongated members 46 to spacer mount 20. Such connectors may include, for example, clips, screw-threaded fasteners, lugs, and slide channels.

Spacer 22 permits encasement machine 10 to tighten and clamp cases 16 having a contour different than the contour of spacer mount 20 closely and accurately. For example, in the illustrated embodiments, spacer mount 20 is circular or near-circular shaped as shown in FIGS. 1–4 and 6. The exhaust processor body 12 to be clamped by encasement machine 10 is generally oval-shaped or non-circular shaped as shown, for example, in FIGS. 1, 4, and 6. The inner surface 52 of spacer members 46 includes an oval-shaped contour for receiving and tightening exhaust processor body 12 illustrated in FIG. 2.

It is not necessary to provide different encasement machines 10 to produce each type, shape, and contour of exhaust processor body 12 because a different type, shape, and contour of spacer 22 can be used in encasement machine 10 to match the strap unit 18 in size and shape to a particular exhaust processor body 12 to be clamped in strap unit 18. Furthermore, spacer 22 avoids the need to design a specially shaped spacer unit for each shape of exhaust processor. The spacer mount 20 can have a standard shape, for example circular or near circular, and be adapted to the shape of exhaust processor body 12 by spacer 22.

The wall 24 is positioned to lie adjacent to inner surface 52 of elongated spacer members 46. The wall 24 is made of metal (e.g. steel) and is coupled to spacer mount 20. The spacer mount 20 and wall 24 include spaced-apart ends 58, 59 that wrap over tips of jaws 14, 16 and are coupled to jaws 14, 16 by bolts 60.

The wall 24 serves to smooth the contour of the contact pressure exerted on exhaust processor body 12 when elongated spacer members 46 do not form a continuous pressure surface over exhaust processor body 12. Size variations in a particular substrate 28 and mat 30 can result in variation in the size of case 32, and the spacers 46 may be spaced apart a small distance to allow for such variation in size about an average size. Also, strap unit 18 includes regions 62 in which no spacer 46 is positioned between spacer mount 20 and wall 24 due to the small space available between spacer mount 20 and wall 24. In these regions 62, the wall 24 ensures that a smooth pressure is applied to exhaust processor body 12. The wall 24 also serves to reduce wear of spacer 22 and to reduce strain on spacer mount 20. A small spacer may be used in these regions 62. The wall 24 may be removed so that spacer 22 bears directly against case 16.

Figure 4:
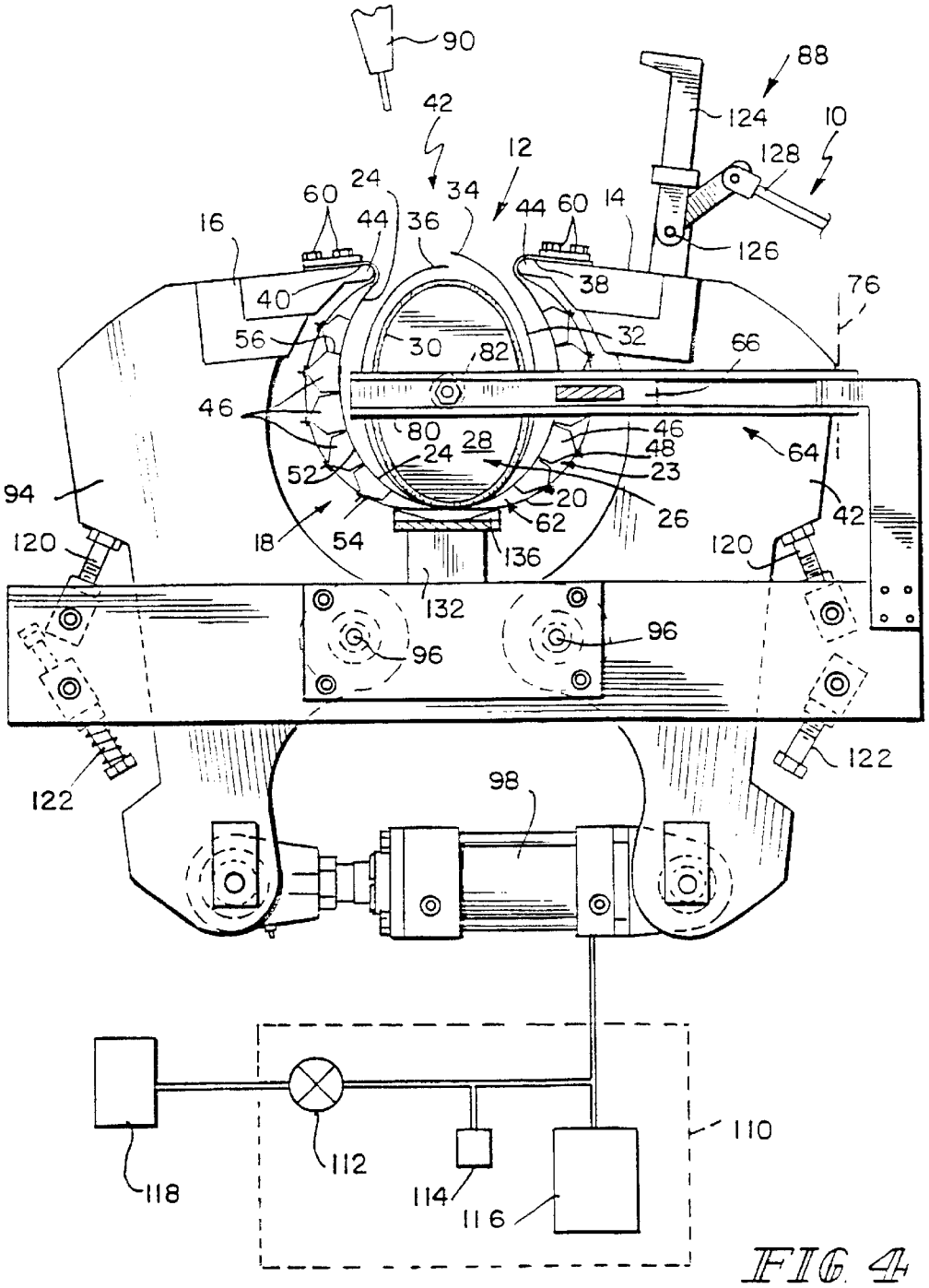
FIG. 4 is a side elevation view of the encasement machine of FIGS. 1 and 2 showing the exhaust processor body positioned in an encasement region defined by the strap unit and between the spaced-apart jaws while the outer case is wrapped loosely around the substrate prior to clamping the exhaust processor body in the encasement region.
Figure 5:
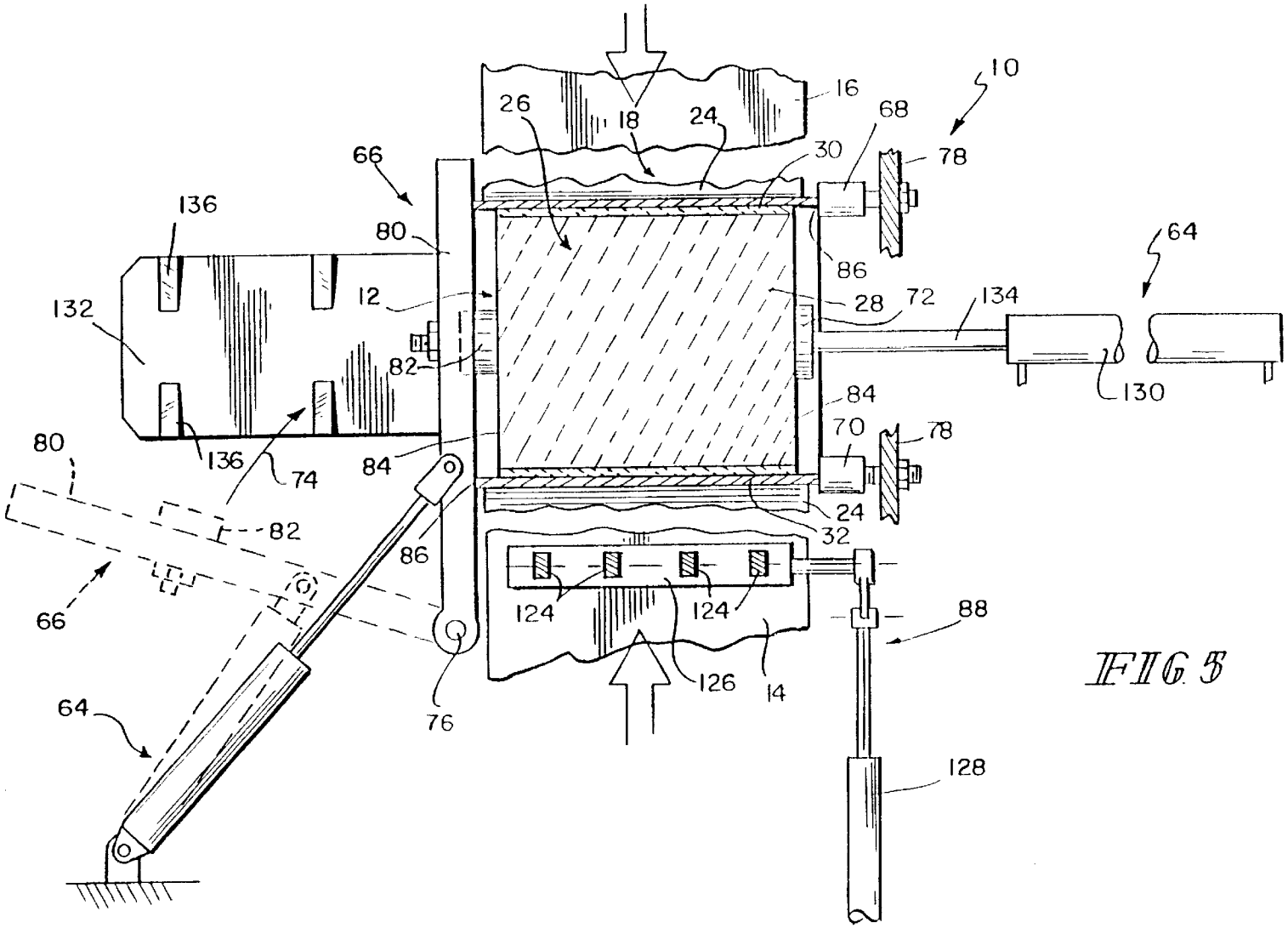
FIG. 5 is a top plan view, with portions cutaway, of the exhaust processor body positioned in the strap unit and between the spaced-apart jaws showing an exhaust processor body positioner included in the encasement machine and configured to position the exhaust processor body properly within the encasement region formed in the encasement machine.

The exhaust processor body 12 is slid into encasement region 26 defined by strap unit 18 when jaws 14, 16 are in a spaced-apart position so that strap unit 18 is relaxed as shown, for example. in FIGS. 4 and 5. The encasement machine 10 further includes an exhaust processor body positioner 64 that positions exhaust processor body 12 within encasement region 26 properly. Exhaust processor body positioner 64 includes an arm 66 and stops 68, 70, 72. Arm 66 cooperates with stops 68, 70, 72 to position exhaust processor body 12 properly in encasement region 26 and position substrate 28 properly relative to outer case 32.

After exhaust processor body 12 is positioned in encasement region 26 of encasement machine 10, arm 66 swings in direction 74 about axis 76 so that arm 66 abuts exhaust processor body 12. Arm 66 cooperates with stops 68, 70, 72 to position exhaust processor body 12 properly in encasement region 26 of encasement machine 10 and position substrate 28 relative to outer case 32. Stops 68, 70 are fixed to a movable plate 78 and engage outer case 32 as shown in FIG. 5. Stop 72 is movable relative to stops 68, 70 and engages substrate 28. Arm 66 includes a flat plate 80 and a stop 82 that is coupled to and movable relative to flat plate 80. Stop 82 of arm 66 engages substrate 28 and flat plate 80 engages outer case 32.

Stops 68, 70, 72, 82 and flat plate 80 position substrate 28 within outer case 32 so that edges 84 of substrate 28 are spaced apart from edges 86 of outer case 32 by a specified distance. The movable plate 78 is movable to accommodate exhaust processor bodies 12 of different sizes. Stops 68, 70 and flat plate 80 that engage outer case 32 are made of a metal material and stops 72, 82 that engage substrate 28 are made of a nylon material. The stops and flat plate may be made of any type of material that will not damage the outer case or substrate.

Figure 6:
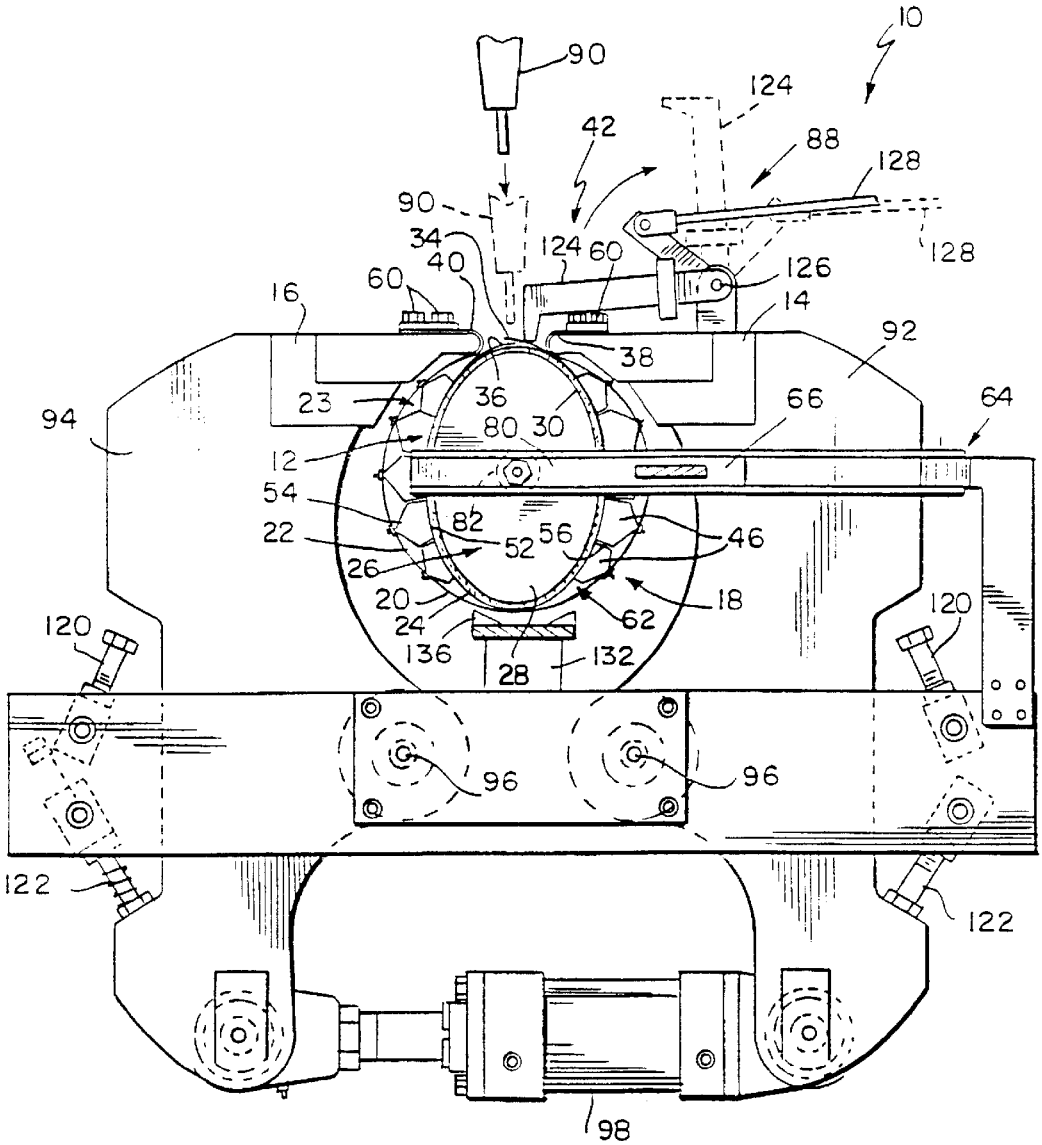
FIG. 6 is a side elevation view similar to FIG. 4 showing the spaced-apart jaws in a compressed position so that the strap unit clamps and wraps the outer case around the mat and substrate, a mechanism swinging down onto the outer case to hold ends of the outer case in a fixed position, and a welder coupling the ends of the outer case to each other, the spacer and wall includes a contour in the compressed position that is substantially identical to the contour of the exhaust processor body.

After exhaust processor body 12 is positioned properly within encasement region 26 of encasement machine 10 the jaws 14, 16 move toward each other so that strap unit 18 moves from a relaxed position to a tightened position to clamp exhaust processor body 12 as shown in FIG. 6. As strap unit 18 tightens, the outer case 32 is compressed circumferentially, such that flared end 34 of outer case 32 overlaps confronting end 36 of outer case 32 and outer case 32 is wrapped tightly around substrate 28.

Encasement machine 10 further includes a mechanism 88 that engages flared end 34 to hold flared end 34 on the other end 36 of case 32 as shown in FIGS. 1, 2, and 6. The mechanism 88 engages flared end 34 after flared end 34 of case 32 overlaps the other end 36 of case 32. The mechanism 88 moves from the position shown in dotted lines to the position shown in solid lines to engage flared end 34 as shown in FIG. 6.

Encasement machine 10 further includes a welder 90 as shown in FIGS. 1, 2, and 6. Once flared end 34 is held securely against the other end 36 of case 32, welder 90 couples ends 34, 36 of case 32 to provide a tightly wrapped exhaust processor body 12.

The jaws 14, 16 are operated by levers 92, 94. respectively, mounted by pivots 96. The levers 92, 94 are driven by a hydraulic cylinder 98. Pressurized fluid is supplied to hydraulic cylinder 98 by a hydraulic control circuit 110, which includes a control valve 112, a pressure sensor 114, and a reservoir 116 as shown in FIG. 4. The fluid is supplied to circuit 110 from a pressurized fluid source 118 such as, for example, a hydraulic power pack (reservoir and pump). The jaws 14, 16, levers 92, 94, hydraulic cylinder 98. and hydraulic control circuit 110 comprise an actuator that moves strap unit 18 between a relaxed position and a clamped position. The jaws may be operated by any suitable driver or power mechanism including, for example, a pneumatic cylinder.

When jaws 14, 16 are in the compressed position shown in FIG. 6, the outer surface 54 of spacer members 46 have a circular or near circular contour to match the contour of spacer mount 20 and the inner surface 52 of spacer members 46 have a contour that matches the cross-sectional shape or contour of exhaust processor body 12 to be wrapped or clamped by encasement machine 10. The spacer 22 ensures that an appropriate surface contact pressure is applied to case 32 during tightening or clamping, to suit the shape of substrate 28. The spacer 22 is configured to apply a substantially radially-inwardly directed force to case 32 from the circular, or near circular, spacer mount 20. The spacer 22 may be made of any suitable material able to bear the clamping pressure without distortion. For example, the spacer may be made of a brass/bronze alloy, and machined or electro-sculpted using computer-aided design apparatus.

Any cross-sectional shape of substrate 28 can be accommodated simply by using a spacer 22 of the correct contour to match the contour of substrate 28. The spacer 22 may be replaced individually or separate from spacer mount 20 and wall 24 (leaving spacer mount 20 and wall 24 in place) or an entire strap unit 18 might be replaced. Thus, different strap units 18 may be provided for different exhaust processor bodies 12 having substrates 28 of varying cross section or contour. To start production of a batch of exhaust processor bodies 12 of any particular type, it is a simple matter to install the appropriate strap unit 18 or spacer 22 in encasement machine 10. The jaws 14, 16 may also be replaced with strap unit 18 to accommodate different size and contoured exhaust processor bodies 12. If either or both of jaws 14, 16 is replaced with strap unit 18 to accommodate different size and contoured exhaust processor bodies 12. then jaws 14, 16 are considered to be part of strap unit 18.

The encasement machine 10 may be operated either to tighten case 32 to a fixed size or to a fixed pressure. It is preferred to tighten case 32 to a fixed pressure, and thus achieve a controlled compression force on mat 30 and substrate 28. The controlled compression force ensures that mat 30 is mounted under optimum conditions to perform its function in supporting substrate 28 securely to prevent substrate 28 from moving, but without crushing substrate 28, and to seal around the circumferential periphery of substrate 28. The case 32 has to have a tight, controlled pressure fit around substrate 28 and mat 30 to ensure that substrate 28 is held securely in position without leaks, around the periphery of substrate 28, and to ensure that substrate 28 does not move under the effects of axial flow pressure, and mechanical vibration and knocks, when in use.

To tighten case 32 to a controlled pressure, the valve 112 is opened until the hydraulic pressure detected by sensor 114 reaches a predetermined level corresponding to the desired tightening pressure of case 32. This predetermined hydraulic pressure can be calculated easily, taking into account the mechanical advantage of the pivoted levers 92, 94. Once the predetermined pressure has been reached, the control valve 112 is closed to prevent possible damage from being caused by over-tightening case 32.

It has been observed that, when compressed, the mat 30 will tend to give, or collapse. over a period of time, such that, after the initial closing (or bracing) of jaws 14, 16, the jaws 14, 16 will creep further closed as mat 30 gives under the applied hydraulic pressure. This gradual relaxing of mat 30 has been observed to last for up to about 15 seconds (possibly up to 30 seconds), after which mat 30 stabilizes under the applied load. The reservoir 116 ensures that the hydraulic pressure within cylinder 98 does not drop below a desired minimum as mat 30 continues to relax after valve 112 has been turned off. The reservoir 116 has sufficient capacity to compensate for hydraulic pressure drops which might otherwise occur within cylinder 98 as jaws 14, 16 and levers 92, 94 creep during the "stabilization" of mat 30 under load.

Alternative techniques may be employed to compensate for the "stabilization" of mat 30. For example, an electronic feedback circuit may be used in the hydraulic control circuit to monitor the hydraulic pressure and to open the control valve to admit more gas if the hydraulic pressure drops below a predetermined threshold. The encasement machine 10 may be operated repeatedly, or cycled several times, before removing the exhaust processor body 12 from encasement machine 10, until no further creeping, or collapsing, of mat 30 is observed. Jaws 14, 16 may be driven by other drive arrangements, for example, electric motors. It is preferred that such other drive arrangements compensate for creep of mat 30, for example, in a similar manner to the techniques described above.

Although a particular arrangement employing jaws 14, 16 has been illustrated for tightening the clamping strap unit 18, any suitable tightening device coupled to the strap may be used. When jaws are used, one of the jaws may. if desired, be fixed in position, such that the tightening is achieved by movement of the non-fixed jaw.

The travel limit positions of jaws 14, 16 are controlled by adjustable stops 120, 122. Two stops 120 define the maximum open position of jaws 14, 16, and two further stops 122 define the maximum closed position of jaws 14, 16.

When jaws 14, 16 begin to be moved toward each other, the mechanism 88 remains in a retracted position as shown in dotted lines FIG. 6, to remain out of contact with case 32. The initial closing movement of jaws 14, 16 causes ends 34, 36 of case 32 to overlap, but to remain spaced above, and out of contact with mat 30 and substrate 28.

Mechanism 88 includes a plurality of fingers 124, a support bar 126, and an actuator 128 that moves fingers 124 in and Out of gap 42 defined by ends 38, 40 of strap unit 18 and engagement with flared end 34. Mechanism 88 is coupled to jaw 14 and moves with jaw 14 as jaw 14 compresses and releases exhaust processor body 12.

When a suitable intermediate clamping position of the jaws 14, 16 is reached, the mechanism 88 is actuated to cause fingers 124 to press on flared end 34 of outer case 32 during the final closing movement of the jaws 14, 16. The fingers 124 press flared end 34 of case 32 inwardly against opposing end 36 of case 32 to cause ends 34, 36 of case 32 to slide relative to each other. Fingers 124 press overlapping ends 34, 36 of outer case 32 against mat 30 as shown in FIG. 4. The mechanism 88 could be moving during the whole closing process of jaws 14, 16, but only make contact with flared end 34 of case 32 during the final part of the closing movement of jaws 14, 16. The mechanism 88 typically contacts case 32 for the final quarter of the closing movement of jaws 14, 16. The mechanism 88 could be coupled to be driven by movement of jaws 14, 16 or mechanism 88 might be driven by a hydraulic cylinder (not shown) coupled to hydraulic circuit 110 shown in FIG. 5.

Although substrate 28 and mat 30 are produced to fairly good production tolerances, the possible size variations of each, and the unpredictable relaxation of mat 30 during compression to a controlled pressure, mean that the overall size of case 32 after tightening, may vary within considerable limits. This variation in size is accommodated by flared end 34 of case 32 which provides a sliding overlap joint with the confronting edge 36 of case 32.

Once case 32 has been tightened and mat 30 has stabilized, the case 32 is welded to secure case 32 in its tightened condition. The gap 42 between ends 38, 40 of strap unit 18 permits good access to perform the welding operation. In one production method, the case 32 is not welded completely alone the length of case 16 while in encasement machine 10, but is simply spot welded at one or more locations, depending on the axial length of the case 32. The spot welds simply serve to hold case 32 in its tightened position until the case 32 is later permanently welded. While exhaust processor body 10 is in encasement machine 10, the spot welding may be performed manually, or by welder 80 as shown in FIG. 5. The case 16 can be welded along its entire length while still in encasement machine 30. The welding can be performed manually, or by welder 80 which is lowered into gap 42 and moved along the length of case 32.

Figure 7:
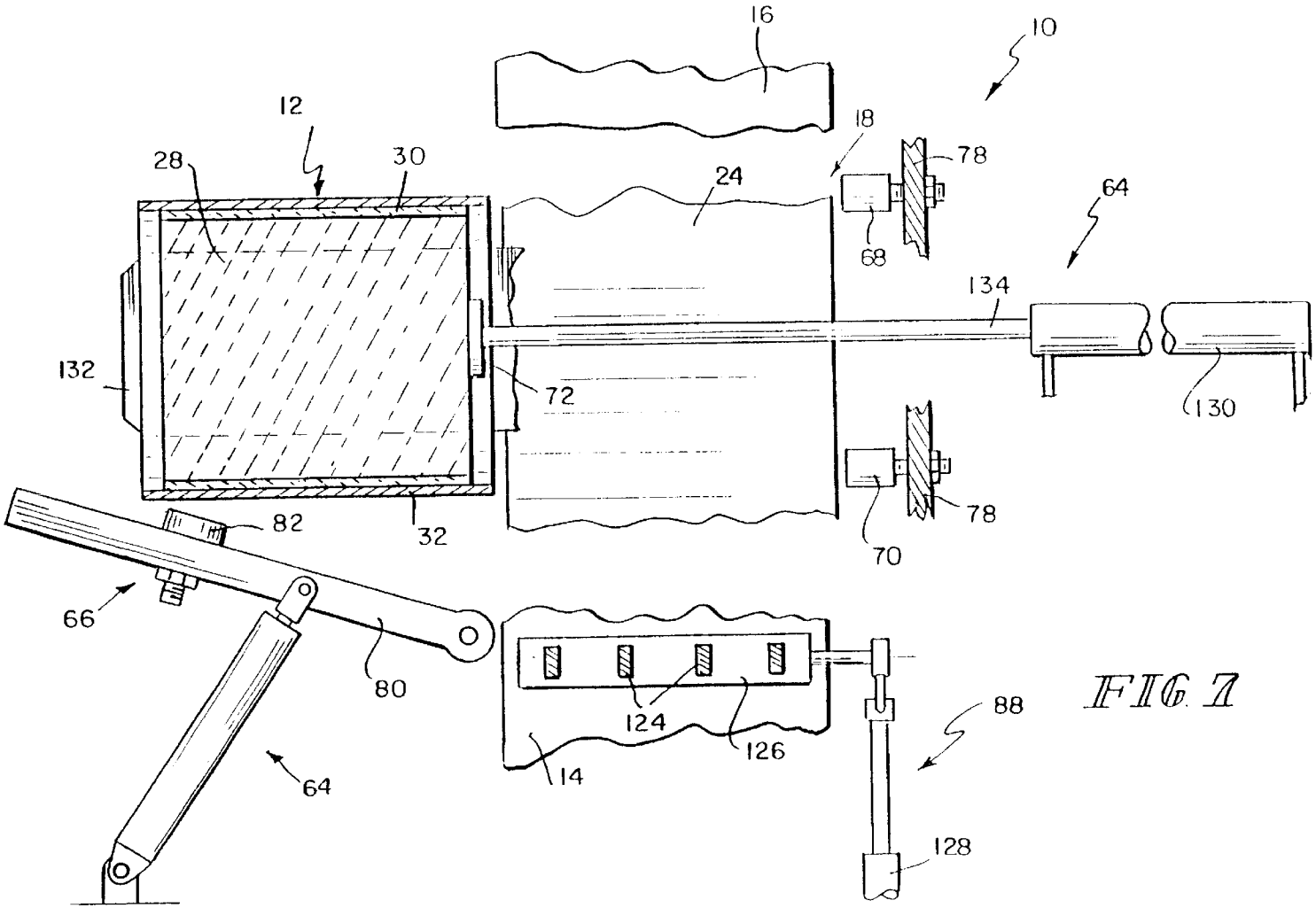
FIG. 7 is a top plan view, with portions cutaway showing the exhaust processor body being ejected or pushed out of the encasement region defined by the strap unit and onto a shelf.

Encasement machine 10 further includes an ejector mechanism 130 which pushes exhaust processor body 12 onto a shelf 132 as shown, for example, in FIG. 7. Shelf 132 includes ramps 136 that support exhaust processor body 12 as shown, for example, in FIG. 5. The ejector mechanism 130 includes a driver 134 that is coupled to stop 72. During the ejection process, stop 72 extends into encasement region 26 to push exhaust processor body 12 onto shelf 132.

Figure 9:
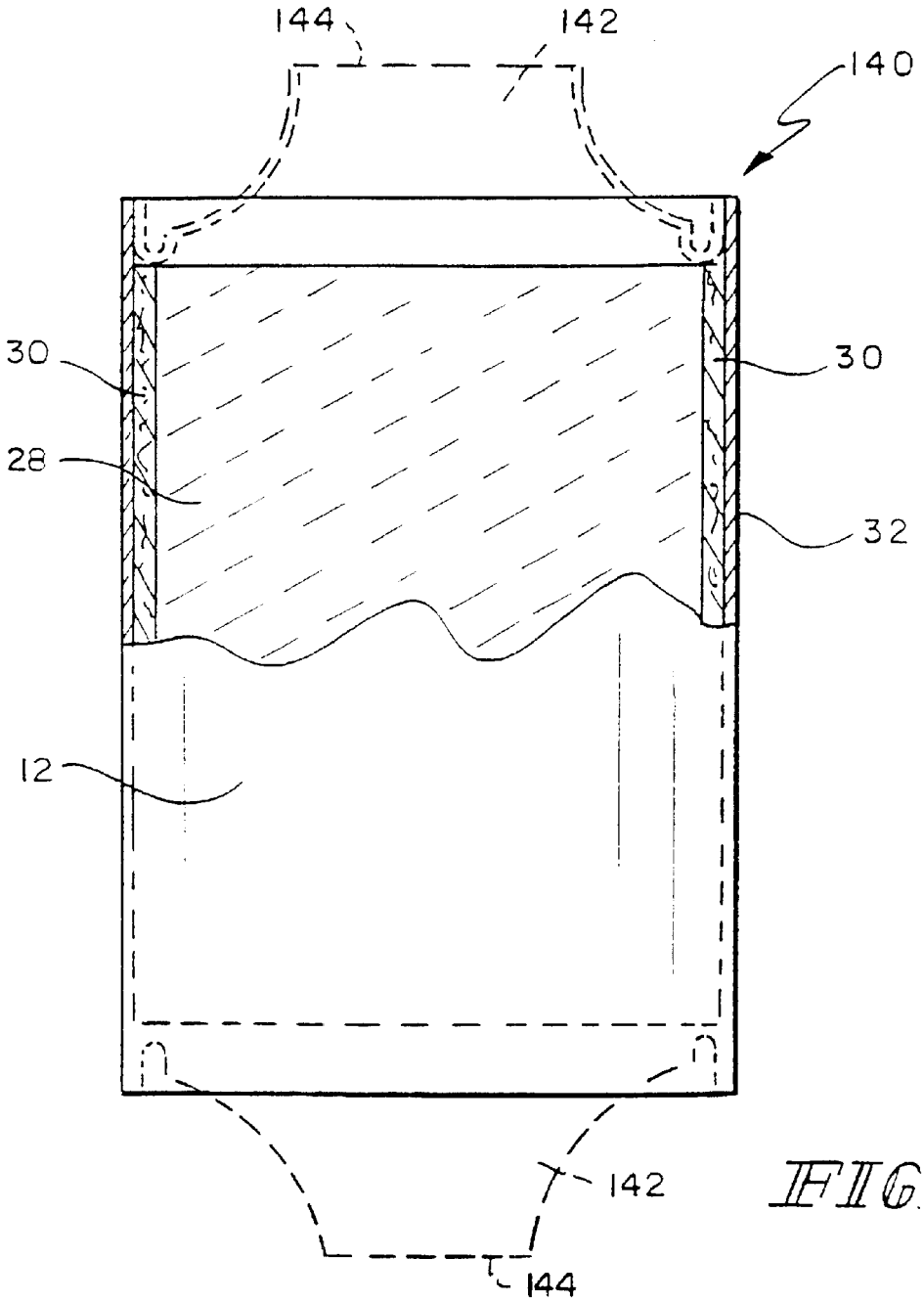
FIG. 9 is a side elevation view, with portions cutaway of an exhaust processor including an exhaust processor body and spaced-apart first and second end caps (in phantom) positioned to abut an inner surface of the case.

The exhaust processor body 12 is part of an exhaust processor 140 as shown in FIG. 9. Exhaust processor 140 includes exhaust processor body 12 and end caps 142 shown in phantom in FIG. 9. The end caps 142 are generally cone (or frusto-cone) shaped and are formed to include ports 144 to enable exhaust processor 140 to be installed in a vehicle exhaust system.

In this application, the words "exhaust processor" are intended to refer to various types of diesel particulate filters and other traps, purifiers or substrates in connection with which this invention may be used. In the illustrated embodiment, the words "exhaust processor" specifically refer to a catalytic device (for example, a catalytic converter or a catalytic trap) for use with gasoline engines.

Figure 8:
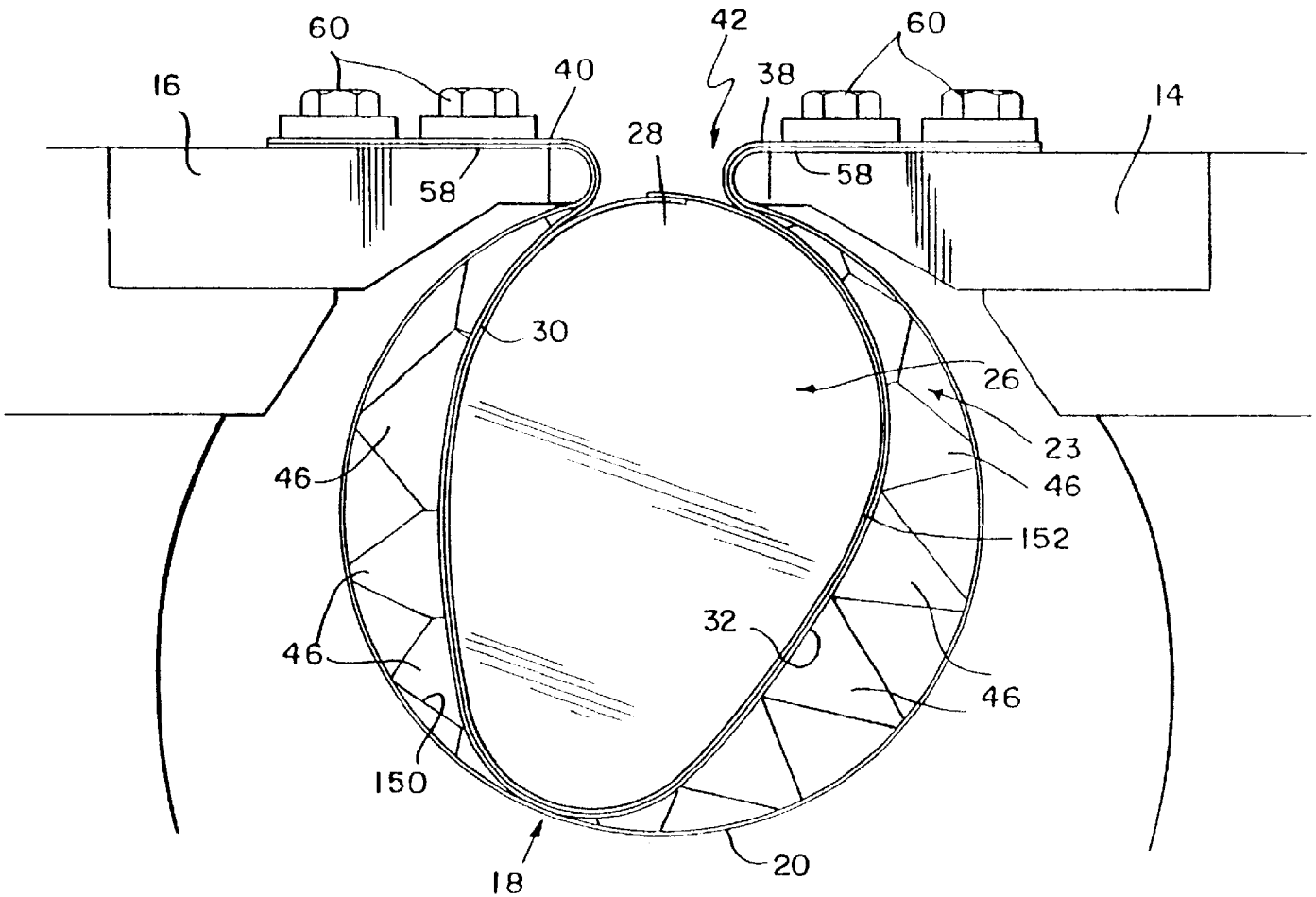
FIG. 8 is a side elevation view of another strap unit including a set of spacers that are shaped and sized differently from the spacers shown in FIGS. 1, 2, 4, and 6, the strap unit being coupled to the spaced-apart jaws and arranged to clamp an exhaust processor body received in the encasement region of the encasement machine, the strap unit having spacers sized to have a contour in the compressed position that is substantially identical to the contour of the exhaust processor body being clamped by the encasement machine.

As discussed above, the encasement machine 10 may clamp exhaust processor bodies 12 of various size and contour by adjusting the size and contour of spacer 22. For example, encasement machine 10 may include a spacer 150 that is sized, shaped, and contoured to clamp a non-symmetrical polygonal type cross section shape or contour exhaust processor body 152 as shown in FIG. 8. The spacer mount 20 of strap unit 18 is circular or near circular, and this maintains an optimum radial, or near radial, force on exhaust processor body 152 during compression.

Figure 10:
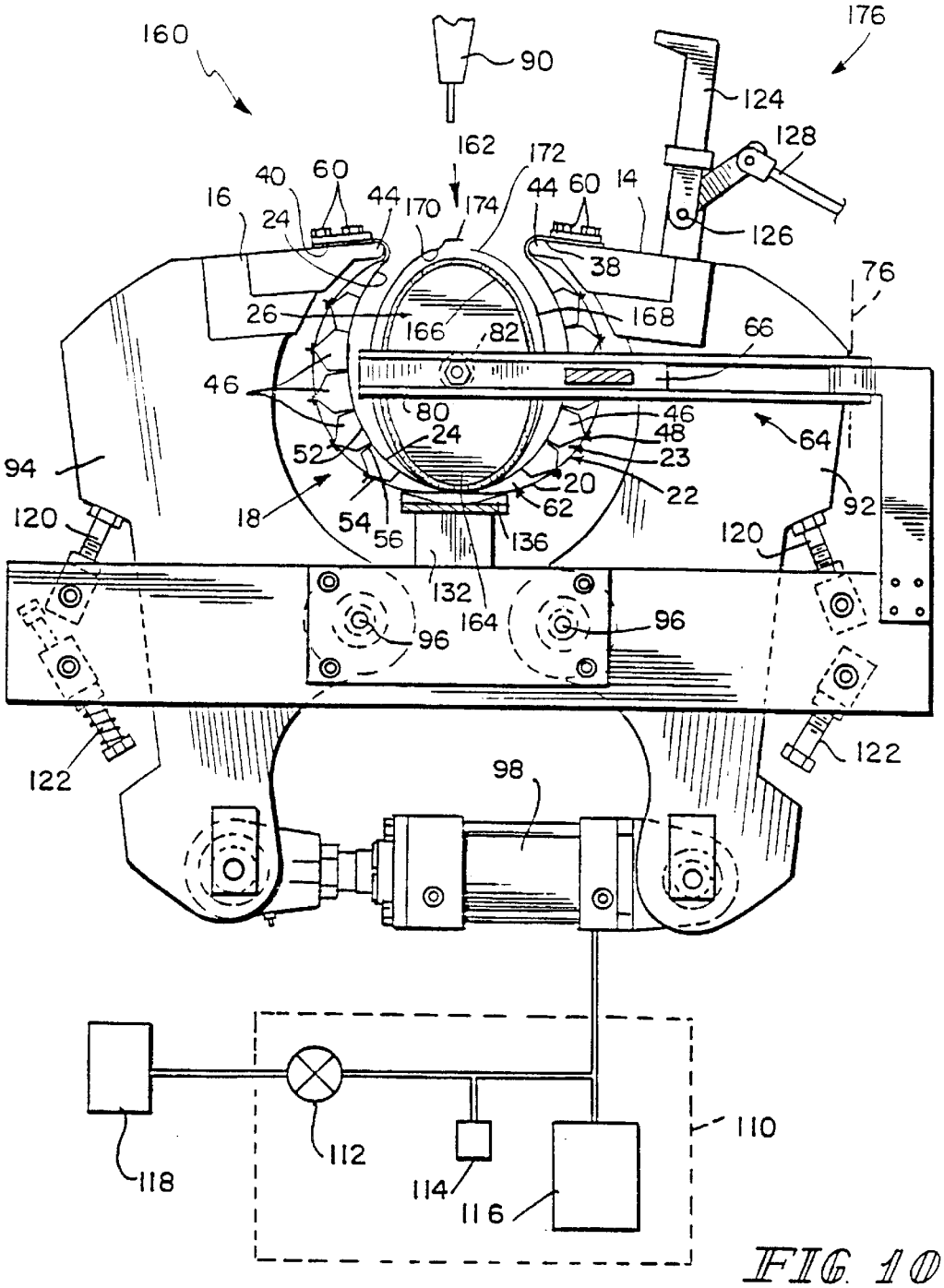
FIG. 10 is a side elevation view of an alternative embodiment of an encasement machine and an exhaust processor body positioned to lie between spaced-apart jaws of the encasement machine.
Figure 12:
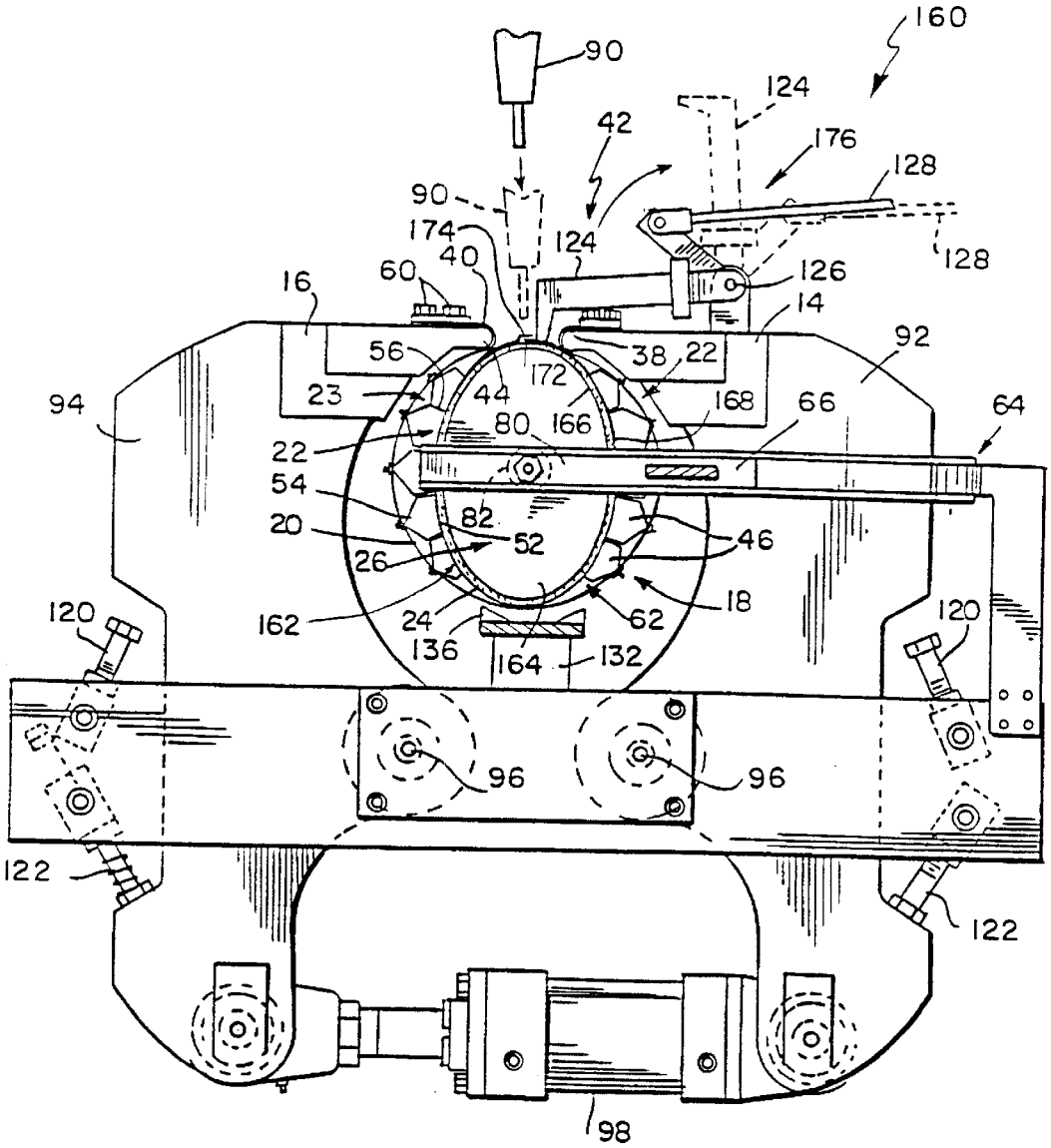
FIG. 12 is a side elevation view similar to FIG. 10 showing the spaced-apart jaws closed to clamp the outer case around the mat and substrate so that the raised lip of the outer case overlaps the other end of the outer case, a mechanism engaged with an end of the outer case and abutting the raised lip of the outer case, and a welder coupling the ends of the outer case.

Another preferred encasement machine 160 that clamps an exhaust processor body 162 is shown in FIGS. 10 and 12. Encasement machine 160 is identical to encasement machine 10 except that encasement machine 160 includes a mechanism 176 that interacts with exhaust processor body 162 in a different manner than mechanism 88 of encasement machine 10 interacts with exhaust processor body 12. All other components of encasement machine 10 are identical to encasement machine 160 and are numbered identically.

Figure 11:
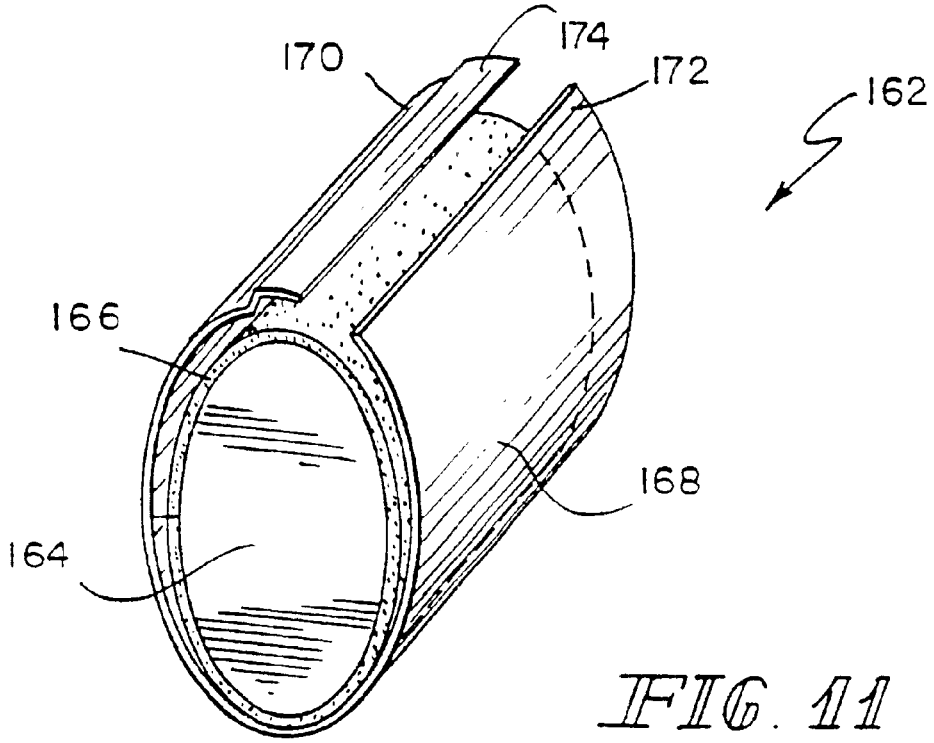
FIG. 11 is a perspective view of the exhaust processor body positioned to lie in the encasement machine of FIG. 10 showing the exhaust processor body including an outer case loosely wrapped around a mat and substrate, the outer case including spaced-apart ends, and one of the ends of the outer case including a raised lip.

The exhaust processor body 162 includes a substrate 164, a mat 166, and an outer case 168 as shown in FIG. 11. The outer case 168 includes spaced-apart ends 170, 172 and one of the ends 170 is lifted or bent to form a lip 174. The lip 174 may, for example, be formed by pressing the sheet metal along an edge prior to bending the sheet metal into case 168. Substrate 164, mat 166, and outer case 168 are assembled as described above in reference to exhaust processor body 12. The exhaust processor body 162 is positioned within encasement region 26 of encasement machine 10 in the same manner as exhaust processor body 12.

When case 168 is tightened and clamped by jaws 14, 16 and strap unit 18, lip 174 of end 170 overlaps the other confronting end 172 of case 168. The mechanism 176 holds end 172 of case 168 down as strap unit 18 clamps outer case 168 about mat 166 and substrate 164 and lip 174 overlaps end 172. The components of mechanism 176 are identical to the components of mechanism 88 of encasement machine 10 and are numbered identically. The difference between mechanisms 88, 176 is that fingers 124 of mechanism 176 engage the end 172 of outer case 168 that is overlapped by the other end 174 of case 168 and fingers 124 of mechanism 88 engage the end 34 of outer case 32 that is overlapping the other end 36 of outer case 36.

The mechanism 176 also provides the secondary function of maintaining the position of lip 174 adjacent to gap 42 defined between ends 38, 40 of strap unit 18 so that welder 80 has access to lip 174. Mechanism 176 can act as a stop if lip 174 abuts fingers 124 during the clamping process to prevent lip 174 from rotating away from gap 42.

Although the illustrated embodiments have been described for encasing a molded ceramics substrate or stone to form a exhaust processor body, it will be appreciated that the invention may find application in any field where it is desired to close a case around an object. Although this invention has been described in detail with reference to certain embodiments, variations and modifications exist within the scope and spirit of the invention as described and as defined in the following claims.

What is claimed is:

1. A machine configured to clamp a case around an object having a contour, the machine comprising a spacer mount defining an encasement region and being adapted to receive an object and a case in the encasement region, an actuator coupled to the spacer mount to move the spacer mount between first and second positions, and a plurality of spacers coupled to the spacer mount to move with the spacer mount between the first and second positions, the spacers having a first surface coupled to the spacer mount and a second surface adapted to face toward the object and case, the second surface having a contour that is substantially identical to the contour of the object, at least two of the plurality of spacers having their first surface with a differently shaped contour from each other, the spacer mount and spacer comprising a strap unit that is coupled to the actuator, and the strap unit including a first end coupled to the actuator at a first location and a second end coupled to the actuator at a second location that is spaced apart a distance from the first location, wherein the actuator is configured to move the first and second ends of the strap unit relative to one another as the spacer mount is moved between the first and second positions to change the amount of distance between the first and second locations and cause the case to be clamped around the object.

2. The machine of claim 1, wherein the spacer mount is one of circular shaped and near circular shaped, the first surface of the spacer is one of circular shaped and near circular shaped, and the second surface of the spacer is noncircular shaped.

3. The machine of claim 1, wherein the spacer includes a plurality of elongated members.

4. The machine of claim 3, wherein the plurality of elongated members are positioned in rows.

5. The machine of claim 3, wherein each of the plurality of elongated members includes an outer surface coupled to the spacer mount, an inner surface adapted to face toward the body, and a side surface facing toward at least one other of the plurality of spacers.

6. The machine of claim 3, wherein each of the plurality of elongated members includes a distance between the inner and outer surfaces defined by the contour of the object.

7. The machine of claim 1, further comprising a wall coupled to the second surface of the spacer.

8. A machine configured to clamp a case around an object having a contour, the machine comprising a spacer mount defining an encasement region and being adapted to receive an object and a case in the encasement region, an actuator coupled to the spacer mount to move the spacer mount between first and second positions, and a spacer coupled to the spacer mount to move with the spacer mount between the first and second positions, the spacer having a first surface coupled to the spacer mount and a second surface adapted to face toward the object and case, the second surface having a contour that is substantially identical to the contour of the object, the spacer mount and spacer comprising a strap unit that is coupled to the actuator, and the strap unit including a first end coupled to the actuator at a first location and a second end coupled to the actuator at a second location that is spaced apart from the first location, and further comprising a wall coupled to the second surface of the spacer, wherein the wall and spacer mount define a spacer container region and the spacer is positioned to lie in the spacer container region.

9. The machine of claim 1, wherein the actuator includes first and second jaws and a power mechanism configured to move the first and second jaws relative to each other.

10. A machine configured to clamp a case around an object having a contour, the machine comprising a spacer mount defining an encasement region and being adapted to receive an object and a case in the encasement region, an actuator coupled to the spacer mount to move the spacer mount between first and second positions, and a plurality of spacers coupled to the spacer mount to move with the spacer mount between the first and second positions, the spacers having a first surface coupled to the spacer mount and a second surface adapted to face toward the object and case, the second surface having a contour that is substantially identical to the contour of the object, at least two of the plurality of spacers having their first surfaces with a differently shaped contour from each other, the spacer mount and spacer comprising a strap unit that is coupled to the actuator, and the strap unit including a first end coupled to the actuator at a first location and a second end coupled to the actuator at a second location that is spaced apart from the first location, wherein the actuator includes first and second jaws and a power mechanism configured to move the first and second jaws relative to each other and the spacer mount and spacer comprise a strap unit that is coupled to the actuator and the strap unit includes a first end coupled to the first jaw and a second end coupled to the second jaw and the first and second ends define a gap.

11. A machine configured to clamp a case around an object having a contour, the machine comprising a spacer mount defining an encasement region and being adapted to receive an object and a case in the encasement region, an actuator coupled to the spacer mount to move the spacer mount between first and second positions, a spacer coupled to the spacer mount to move with the spacer mount between the first and second positions, the spacer having a first surface coupled to the spacer mount and a second surface adapted to face toward the object and case, the second surface having a contour that is substantially identical to the contour of the object, the spacer mount and spacer comprising a strap unit that is coupled to the actuator, and the strap unit including a first end coupled to the actuator at a first location and a second end coupled to the actuator at a second location that is spaced apart from the first location, wherein the actuator includes first and second jaws and a power mechanism configured to move the first and second jaws relative to each other and the spacer mount and spacer comprise a strap unit that is coupled to the actuator and the strap unit includes a first end coupled to the first jaw and a second end coupled to the second jaw and the first and second ends define a gap, and further comprising a mechanism coupled to one of the first and second jaws and configured to extend in and out of the gap defined by the first and second ends of the strap unit to one of engage and disengage the case.

12. A machine configured to clamp a case around an object having a contour, the machine comprising a spacer mount defining an encasement region and being adapted to receive an object and a case in the encasement region, an actuator coupled to the spacer mount to move the spacer mount between first and second positions, a spacer coupled to the spacer mount to move with the spacer mount between the first and second positions, the spacer having a first surface coupled to the spacer mount and a second surface adapted to face toward the object and case, the second surface having a contour that is substantially identical to the contour of the object, the spacer mount and spacer comprising a strap unit that is coupled to the actuator, and the strap unit including a first end coupled to the actuator at a first location and a second end coupled to the actuator at a second location that is spaced apart from the first location, wherein the actuator includes first and second jaws and a power mechanism configured to move the first and second jaws relative to each other and the spacer mount and spacer comprise a strap unit that is coupled to the actuator and the strap unit includes a first end coupled to the first jaw and a second end coupled to the second jaw and the first and second ends define a gap, and further comprising a welder configured to extend in and out of the gap defined by the first and second ends of the strap unit.

13. A method of encasing an object within a case, the case including spaced-apart first and second ends, and the object having a contour, the method comprising the steps of providing an encasement machine having an actuator and a plurality of strap units, the plurality of strap units having an inner surface adapted to face toward the object, the inner surface of the plurality of strap units having a contour, selecting one of the plurality of strap units that includes an inner surface having a contour substantially similar to the contour of the object, coupling the one of the plurality of strap units to the actuator, placing the object within the case, placing the object and case within the encasement machine so that the inner surface of the one of plurality of strap units faces toward the case and object, and operating the actuator to move the one of the plurality of strap units so that the one of the plurality of strap units clamps the case on the object so that the first end of the case is wrapped over the second end of the case.

14. The method of claim 13, wherein the strap unit includes a spacer mount coupled to the actuator and a plurality of spacers and each of the plurality of spacers have an inner surface adapted to face toward the object.

15. The method of claim 14, wherein the selecting step includes selecting one of the plurality of spacers that includes an inner surface having a contour substantially similar to the contour of the object.

16. The method of claim 13, wherein the strap unit includes a spacer mount and a spacer coupled to the spacer mount, the spacer includes an inner surface adapted to face toward the object, and the selecting step includes selecting a spacer mount and spacer that includes a spacer having an inner surface that has a contour substantially similar to the contour of the object.

17. The method of claim 13, wherein the encasement machine further includes a welder and the method further comprises the step of welding the case after the operating step.

18. The method of claim 17, wherein the encasement machine further includes a mechanism configured to engage and hold the case during the welding step.

19. A machine configured to clamp a case around an object including an outer surface defining a curved contour to conform the case to the outer surface of the object, the machine comprising a spacer mount having an inner surface defining a first contour and an encasement region sized to receive therein an object and a case around the object, an actuator coupled to the spacer mount to move the spacer mount from a first position to a second position while an object and a case are positioned to lie in the encasement region, a spacer coupled to the spacer mount to move therewith, the spacer including an outer end engaging the inner surface of the spacer mount and an inner surface defining a second contour that differs from the first contour and matches a curved contour of an outer surface of an object positioned to lie in the encasement region upon movement of the actuator to the second position and is adapted to clamp a case in the encasement region around an object in the encasement region to conform the case to the curved contour of the outer surface of the object and further comprising a wall lying in the encasement region and cooperating with the inner surface of the spacer mount to define a space therebetween and the spacer is positioned to lie in the space, wherein the spacer includes a plurality of spacer members, each spacer member includes a curved surface, the spacer members are arranged to present the curved surfaces toward a case received in the encasement region, the curved surfaces cooperate to define the inner surface of the spacer, and the wall is positioned to engage the inner surface of the spacer defined by the curved surfaces of the spacer members and is interposed between the spacer and a case received in the encasement region.

20. The method of claim 13, wherein the encasement machine further includes a welder and the method further comprises the step of welding the first end of the case to the second end of the case.

21. The method of claim 20, wherein the encasement machine further includes a mechanism configured to engage and press the first end of the case onto the second end of the case during the welding step.

22. The method of claim 13, wherein the first end of the case is flared relative to the second end of the case to permit the first end of the case to overlap the second end of the case during the wrapping step.

23. An encasement machine for encasing a case around an object having a contour, the encasement machine comprising an actuator configured to move between first and second positions, and a strap unit coupled to the actuator to move with the actuator between the first and second positions, the strap unit defining an encasement region, the strap unit being adapted to receive the object in the encasement region when the actuator is in the first position and clamp the object when the strap unit is in the second position, the strap unit including a spacer mount, a wall, and a spacer positioned to lie between the wall and spacer mount, the spacer having an outer surface facing toward the spacer mount and an inner surface facing toward the wall, the inner surface of the spacer having a spacer contour when the actuator is in the second position that is substantially similar to the contour of the object, the outer surface of the spacer including a contour when the actuator is in the second position that is different than the contour of the inner surface of the spacer when the actuator is in the second position.

24. A machine configured to clamp a case around an object including an outer surface defining a curved contour to conform the case to the outer surface of the object, the machine comprising a spacer mount having an inner surface defining a first contour and an encasement region sized to receive therein an object and a case around the object, an actuator coupled to the spacer mount to move the spacer mount from a first position to a second position while an object and a case are positioned to lie in the encasement region, a spacer coupled to the spacer mount to move therewith, the spacer including an outer end engaging the inner surface of the spacer mount and an inner surface defining a second contour that differs from the first contour and matches a curved contour of an outer surface of an object positioned to lie in the encasement region upon movement of the actuator to the second position and is adapted to clamp a case in the encasement region around an object in the encasement region to conform the case to the curved contour of the outer surface of the object and further comprising a wall lying in the encasement region and cooperating with the inner surface of the spacer mount to define a space therebetween and the spacer is positioned to lie in the space, wherein the spacer mount includes a pair of grip portions coupled to the actuator and a mount portion positioned to lie between the grip portions and formed to include the inner surface of the spacer mount and the wall includes spaced-apart ends that are coupled to the actuator to cause the wall to move to engage a case received in the encasement region during movement of the spacer mount from the first position to the second position.

25. The machine of claim 23, wherein the wall includes a contour substantially similar to the contour of the inner surface of the spacer.

26. A machine for encasing an object in a metal case, the machine comprising a strap that is one of arranged and arrangeable at least partly around the object and the metal case to encase the object, means for tightening the strap to force the strap one of around and against the metal case, the tightening means including a first jaw coupled to one portion of the strap, a second jaw coupled to another portion of the strap wherein the coupling location on the first jaw is separated by a distance from the coupling location on the second jaw, and a jaw mover arranged to move the first and second jaws toward and apart from one another to change the distance between coupling locations, and a plurality of contour-modifying spacers arranged or arrangeable between the strap and the metal case for defining an encasing contour different from the contour of the strap, the spacer including an inner surface and an outer surface, and the outer surface of the spacers including a contour when the tightening means forces the strap one of around and against the body that is different from the contour of the inner surface of the spacer when the tightening means forces the strap one of around and against the body and wherein at least two of the plurality of spacers have surfaces with a differently shaped contour from each other.

27. A machine for encasing an object in a metal case, the machine comprising a strap that is one of arranged and arrangeable at least partly around the object and the metal case to encase the object, means for tightening the strap to force the strap one of around and against the body, and a plurality of contour-modifying spacers arranged or arrangeable between the strap and the metal case for defining an encasing contour different from the contour of the strap, the spacer including an inner surface and an outer surface, and the outer surface of the spacers including a contour when the tightening means forces the strap one of around and against the body that is different from the contour of the inner surface of the spacer when the tightening means forces the strap one of around and against the body, wherein at least two of the plurality of spacers have surfaces with a differently shaped contour from each other, and wherein the at least one contour-modifying spacer includes individual formed parts positioned against each other and at the side of contact pressure form a contour which corresponds to the object to be encased.

28. A machine for encasing an object in a metal case, the machine comprising a strap that is one of arranged and arrangeable at least partly around the object and the metal case to encase the object, means for tightening the strap to force the strap one of around and against the body, and a plurality of contour-modifying spacers arranged or arrangeable between the strap and the metal case for defining an encasing contour different from the contour of the strap, the spacer including an inner surface and an outer surface, and the outer surface of the spacer including a contour when the tightening means forces the strap one of around and against the body that is different from the contour of the inner surface of the spacer when the tightening means forces the strap one of around and against the body, wherein at least two of the plurality of spacers have surfaces with a differently shaped contour from each other, and wherein the tightening means includes first and second jaws and the strap is bent at a clamping side and is connected to the clamping jaws.

29. The machine of claim 28, wherein the clamping jaws have lugs at their ends around which the clamping strap is bent.

30. The machine of claim 28, wherein the clamping jaws are pivotally mounted to a table by way of levers.

31. A method of encasing an object in a metal sheet, the method comprising the steps of providing a machine including a wall and a strap extending at least partly around an encasement region for receiving the object and the metal sheet to encase the metal sheet and object, means for tightening the strap to force the wall and strap around the metal sheet and object, and arranging one or more contour-modifying spacers between the wall and the strap prior to tightening of the strap to provide an encasement contour different from the contour of the strap.

32. A method of encasing a body with a sheet metal case, the method comprising inserting a preformed metal sheet and the body into an encasement region of an encasing apparatus, the encasement region being defined by a wall, a strap and one or more contour-modifying spacers interposed between the wall and the strap; and operating the apparatus to tighten the strap, and thereby to force the sheet metal around the body, the contour-modifying spacers providing a different surface pressure encasement contour for the wall from the contour of the strap.

33. A machine configured to clamp a case around an object having a contour, the machine comprising a spacer mount defining an encasement region and being adapted to receive an object and a case in the encasement region, the spacer mount including a wall, a strap and contour modifying spacers between the wall and the strap having a contour that is different than the contour of the object, an actuator coupled to the spacer mount to move the spacer mount between first and second positions, to cause the contour modifying spacers to modify the contour of the spacer mount so that the spacer mount can apply a substantially uniform clamping pressure to the object when the actuator moves the spacer mount from the first position to the second position.

34. A machine configured to clamp a case on an object having a contour, the machine comprising a spacer mount defining an encasement region and being adapted to receive an object and a case in the encasement region, an actuator coupled to the spacer mount to move the spacer mount between first and second positions, the actuator being in the second position when the case is clamped on the object, and a spacer wall positioned adjacent to the spacer mount to move with the spacer mount between the first and second positions, the spacer wall having a first surface facing toward the spacer mount and a second surface adapted to face toward the object and case, the second surface having a contour that is substantially identical to the contour of the object, and the first surface of the spacer including a contour when the actuator is in the second position that is different from the contour of the second surface of the spacer when the actuator is in the second position, and a plurality of individual spacer members arranged to lie in side-by-side relation to one another between the first surface of the spacer wall and the spacer mount when the actuator is in the first position and in the second position.

35. A machine configured to clamp a case around an object including an outer surface defining a curved contour to conform the case to the outer surface of the object, the machine comprising a spacer mount having an inner surface defining a first contour and an encasement region sized to receive therein an object and a case around the object, an actuator coupled to the spacer mount to move the spacer mount from a first position to a second position while an object and a case are positioned to lie in the encasement region, a spacer coupled to the spacer mount to move therewith, the spacer including an wall with an outer end engaging the inner surface of the spacer mount and a U-shaped curved inner surface defining a second contour that differs from the first contour and matches a curved contour of an outer surface of an object positioned to lie in the encasement region upon movement of the actuator to the second position and a contour spacer device located between the U-shaped curved inner surface and the spacer mount which spacer is adapted to clamp a case in the encasement region around an object in the encasement region to conform the case to the curved contour of the outer surface of the object when the actuator moves the spacer mount to the second position.

36. The machine of claim 35, wherein the spacer device includes a plurality of spacer members.

37. The machine of claim 36, wherein each spacer member includes a pentagonal cross-sectional shape.

38. The machine of claim 36, wherein each spacer member includes a curved surface and the spacer members are coupled to the spacer mount to present the curved surfaces toward a case received in the encasement region and the curved surfaces cooperate to define the inner surface of the spacer.

39. The machine of claim 36, wherein a first of the spacer members has a first shape, a second of the spacer members has a second shape and is larger in size than the first of the spacer members, and a third of the spacer members has a third shape and is larger in size than the second of the spacer members.

40. The machine of claim 35, wherein the spacer device includes a first set of spacer members arranged in series and positioned to lie in a first location on the inner surface of the spacer mount and a second set of spacer members arranged in series and positioned to lie in a second location on the inner surface of the spacer mount in spaced-apart relation to the first set of spacer members.

41. A machine configured to clamp a case around an object including an outer surface defining a curved contour to conform the case to the outer surface of the object, the machine comprising a spacer mount having an inner surface defining a first contour and an encasement region sized to receive therein an object and a case around the object, an actuator coupled to the spacer mount to move the spacer mount from a first position to a second position while an object and a case are positioned to lie in the encasement region, a spacer coupled to the spacer mount to move therewith, the spacer including an outer end engaging the inner surface of the spacer mount and an inner surface defining a second contour that differs from the first contour and matches a curved contour of an outer surface of an object positioned to lie in the encasement region upon movement of the actuator to the second position and is adapted to clamp a case in the encasement region around an object in the encasement region to conform the case to the curved contour of the outer surface of the object, wherein the spacer includes a first set of spacer members arranged in series and positioned to lie in a first location on the inner surface of the spacer mount and a second set of spacer members arranged in series and positioned to lie in a second location on the inner surface of the spacer mount in spaced-apart relation to the first set of spacer members and further comprising a wall lying in the encasement region and cooperating with the inner surface of the spacer mount to define therebetween a first spacer container region containing the first set of spacer members and a separate second spacer container region containing the second set of spacer members.

42. The machine of claim 41, wherein each spacer member includes a curved surface, the spacer members are arranged to present the curved surfaces toward a case received in the encasement region, the curved surfaces cooperate to define the inner surface of the spacer, and the wall is positioned to engage the inner surface of the spacer defined by the curved surfaces of the spacer members and is interposed between the spacer and a case received in the encasement region.

43. The machine of claim 42, wherein the spacer mount includes a pair of grip portions coupled to the actuator and a mount portion positioned to lie between the grip portions, the mount portion includes the inner surface of the spacer mount, the inner surface of the spacer mount includes a first side region engaging the spacer members in the first set of spacer members, a second side region engaging the spacer members in the second set of spacer members, and a middle region positioned to lie between the first and second side regions and engage a middle portion of the wall.

44. The machine of claim 41, wherein the spacer mount includes a pair of grip portions coupled to the actuator and a mount portion positioned to lie between the grip portions and formed to include the inner surface of the spacer mount and the wall includes spaced-apart ends that are coupled to the actuator to cause the wall to move to engage a case received in the encasement region during movement of the spacer mount from the first position to the second position.

45. The machine of claim 44, wherein the wall includes an inner surface adapted to engage a case received in the encasement region and an outer surface including a first side region engaging the spacer members in the first set of spacer members, a second side region engaging the spacer members in the second set of spacer members, and a middle region positioned to lie between the first and second side regions and engage a middle portion of the inner surface of the spacer mount.

46. The machine of claim 35, further comprising a welder and means for using the welder to weld one end of the case to another end of the case while the case is conformed to the curved contour of the outer surface of the object.

47. The machine of claim 46, further comprising a mechanism configured to engage and press said one end of the case onto said another end of the case during welding operations using the welder.

48. The machine of claim 47, wherein said one end of the case is flared relative to said another end of the case to permit said one end of the case to overlap said another end of the case.

* * * * *